US011577378B2

(12) United States Patent
Chen

(10) Patent No.: US 11,577,378 B2
(45) Date of Patent: Feb. 14, 2023

(54) COMBINED TOOLBOX

(71) Applicant: MING SHIN TOOLS CO., LTD., Taichung (TW)

(72) Inventor: Yung-Shun Chen, Taichung (TW)

(73) Assignee: MING SHIN TOOLS CO., LTD., Taichung (TW)

( * ) Notice: Subject to any disclaimer, the term of this patent is extended or adjusted under 35 U.S.C. 154(b) by 30 days.

(21) Appl. No.: 17/204,365

(22) Filed: Mar. 17, 2021

(65) Prior Publication Data

US 2022/0297283 A1 Sep. 22, 2022

(51) Int. Cl.
*B25H 3/02* (2006.01)
*B25H 3/06* (2006.01)

(52) U.S. Cl.
CPC ..... *B25H 3/028* (2013.01); *B25H 3/06* (2013.01)

(58) Field of Classification Search
CPC ..... B25H 3/028; B25H 3/06; B65D 2519/00577; B65D 2519/00611; B65D 2519/00616
USPC ..... 206/372
See application file for complete search history.

(56) References Cited

U.S. PATENT DOCUMENTS 5,546,872 A * 8/1996 Young ..... B65D 19/0012 108/56.1
6,637,592 B1 * 10/2003 Lai ..... B25H 3/023 312/902
7,497,328 B2 * 3/2009 Tonelli ..... B25H 3/02 206/349
11,325,242 B1 * 5/2022 Chen ..... B25H 3/022
2010/0108549 A1 * 5/2010 Eggers ..... B25H 3/028 206/349
2010/0224527 A1 * 9/2010 Huang ..... B25H 3/028 206/503

OTHER PUBLICATIONS

Becksvoort, C. (Jun. 2010). Use bed bolts fora knock-down table . FineWoodworking. Retrieved Jun. 10, 2022, from https://www.finewoodworking.com/2010/04/08/use-bed-bolts-for-a-knock-down-table (Year: 2010).*

* cited by examiner

*Primary Examiner* — Rafael A Ortiz
*Assistant Examiner* — Sanjidul Islam
(74) *Attorney, Agent, or Firm* — Muncy, Geissler, Olds & Lowe, P.C.

(57) ABSTRACT

A combined toolbox is provided, including: first side walls, each first side wall including connection projections; second side walls, each second side wall including connection recesses, adjacent first and second side walls being connected by engagement of the connection projections within the connection recesses, the first and second side walls defining a receiving space; fastening assemblies, each fastening assembly including a bolt and a nut; wherein one of the adjacent first and second side walls further includes through holes and the other further includes receiving holes which respectively correspond to the through holes; wherein each receiving hole receives one nut, each bolt is disposed through one of the through holes and within one of the receiving holes and is screwed with one nut, and the bolt and the nut of each of the fastening assemblies fixedly secure the adjacent first and second side walls.

6 Claims, 12 Drawing Sheets

COMBINED TOOLBOX

BACKGROUND OF THE INVENTION

Field of the Invention

The present invention relates to a combined toolbox.

Description of the Prior Art

Generally, when fixing objects, drive tools (such as wrenches, sockets, screwdrivers or the like) are used to drive fasteners or connectors for assembling/disassembling. However, there are a variety of sizes and types of drive tools, so that toolboxes are often used for easy storage and carrying of the drive tools.

The conventional toolbox includes a plurality of plastic plates, the plurality of plastic plates are assembled by screws, which is advantageous for convenient and fast assembling. The screw is disposed through one plastic and directly screwed to another plastic plate. No matter the portion of the plastic plate to which the screw is screwed is of a solid or hollow structure, it is easy to unscrew, detach or break, due to its low structural strength of the plastic material, when the toolbox is moved, dropped or subjected to external forces or impact.

The present invention is, therefore, arisen to obviate or at least mitigate the above-mentioned disadvantages.

SUMMARY OF THE INVENTION

The main object of the present invention is to provide a combined toolbox which is easy and quick to assemble, good in combination, and has strong connection strength which prevents detachment or breakdown.

To achieve the above and other objects, a combined toolbox is provided, including: a plurality of first side walls, each of the plurality of first side walls including a plurality of connection projections; a plurality of second side walls, each of the plurality of second side walls including a plurality of connection recesses, adjacent said first and second side walls being connected by engagement of the plurality of connection projections within the plurality of connection recesses, the plurality of first side walls and the plurality of second side walls defining a receiving space; a plurality of fastening assemblies, each of the plurality of fastening assemblies including a bolt and a nut; wherein one of the adjacent said first and second side walls further includes a plurality of through holes, and the other of the adjacent said first and second side walls further includes a plurality of receiving holes which respectively correspond to the plurality of through holes; wherein each of the plurality of receiving holes receives one said nut, each said bolt is disposed through one of the plurality of through holes and within one of the plurality of receiving holes and is screwed with one said nut, and the bolt and the nut of each of the plurality of fastening assemblies fixedly secure the adjacent said first and second side walls.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
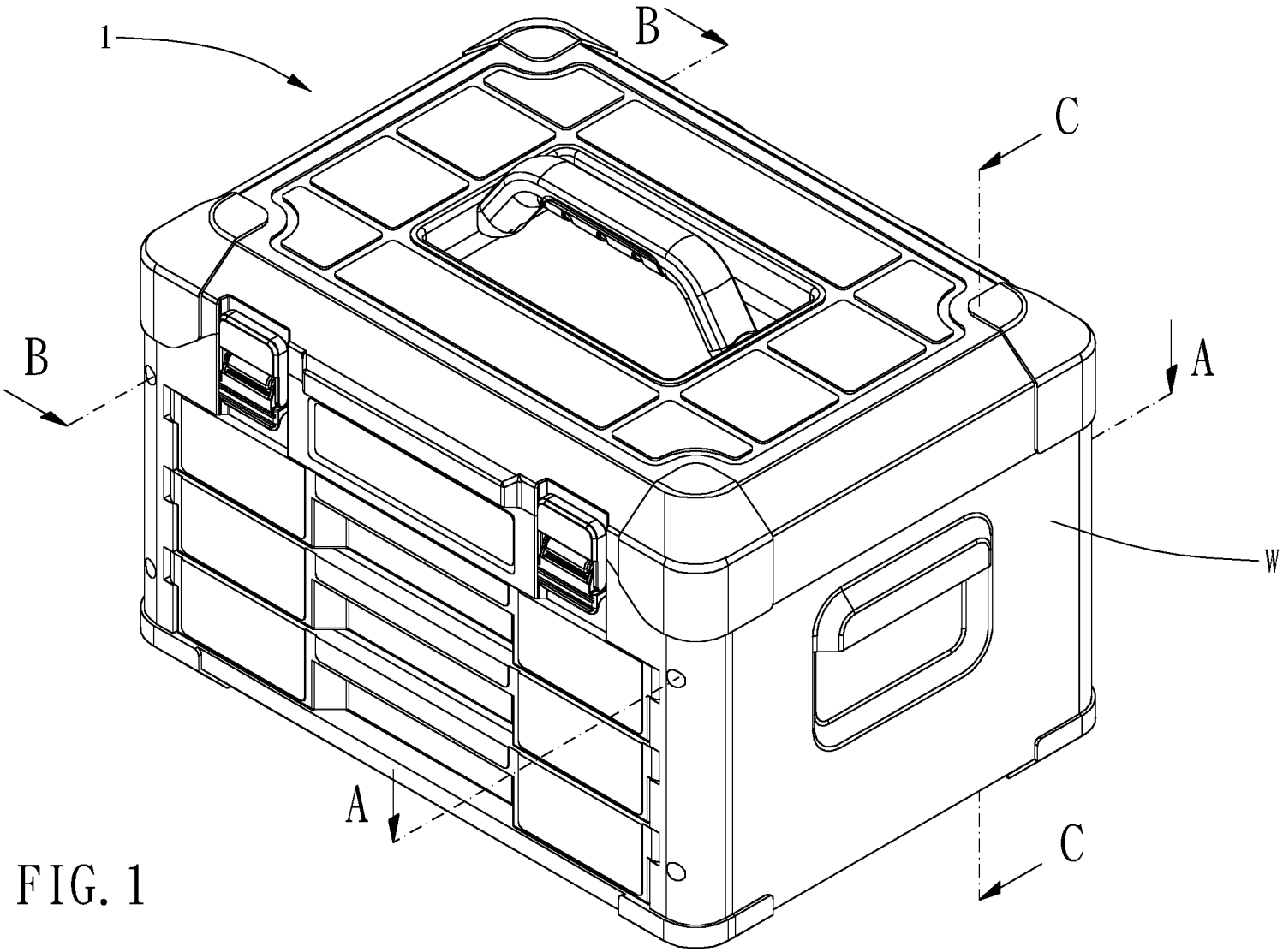
FIG. 1 is a stereogram of a preferable embodiment of the present invention.
Figure 2:
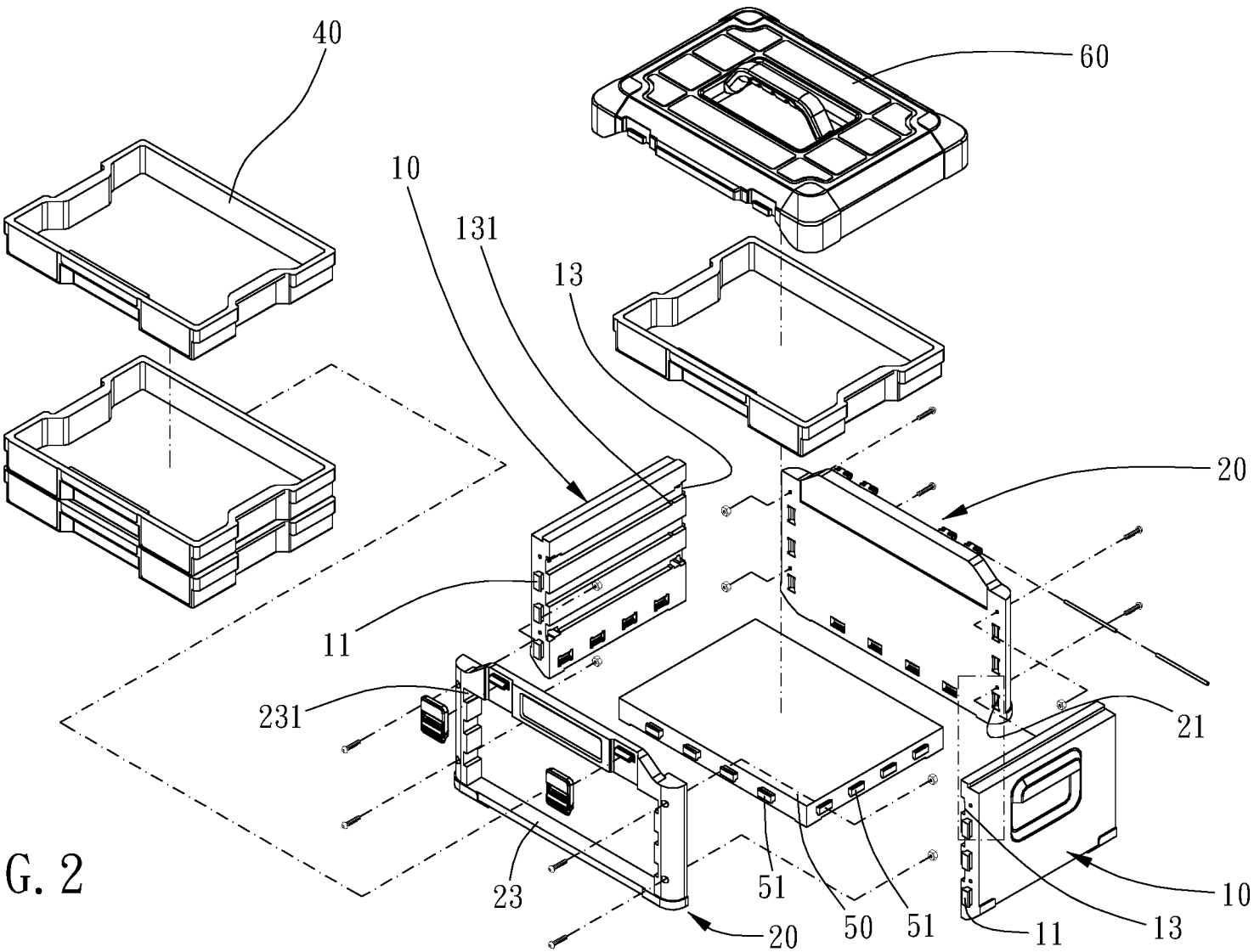
FIG. 2 is a breakdown drawing of a preferable embodiment of the present invention.
Figure 3:
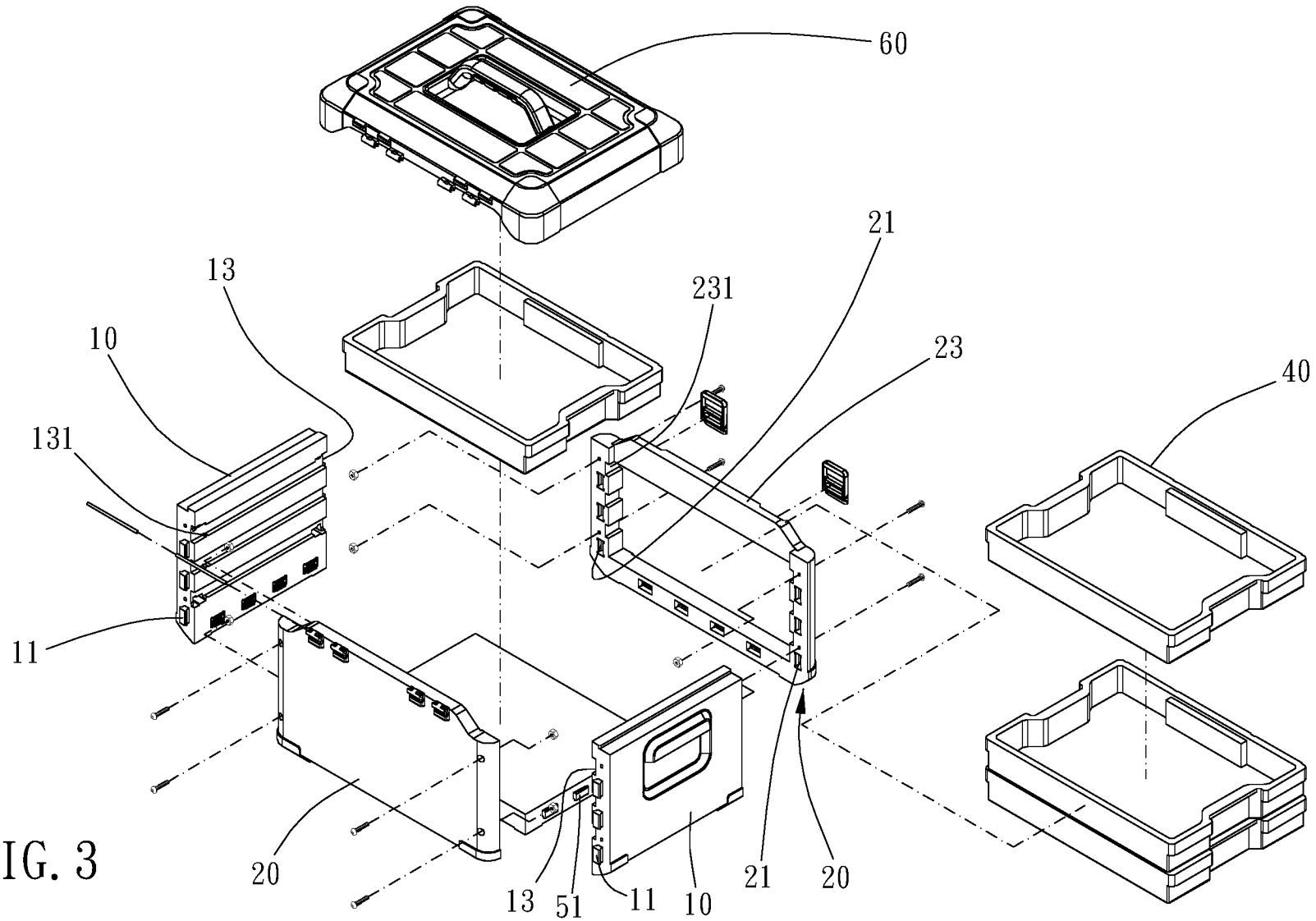
FIG. 3 is another breakdown drawing of a preferable embodiment of the present invention.
Figure 4:
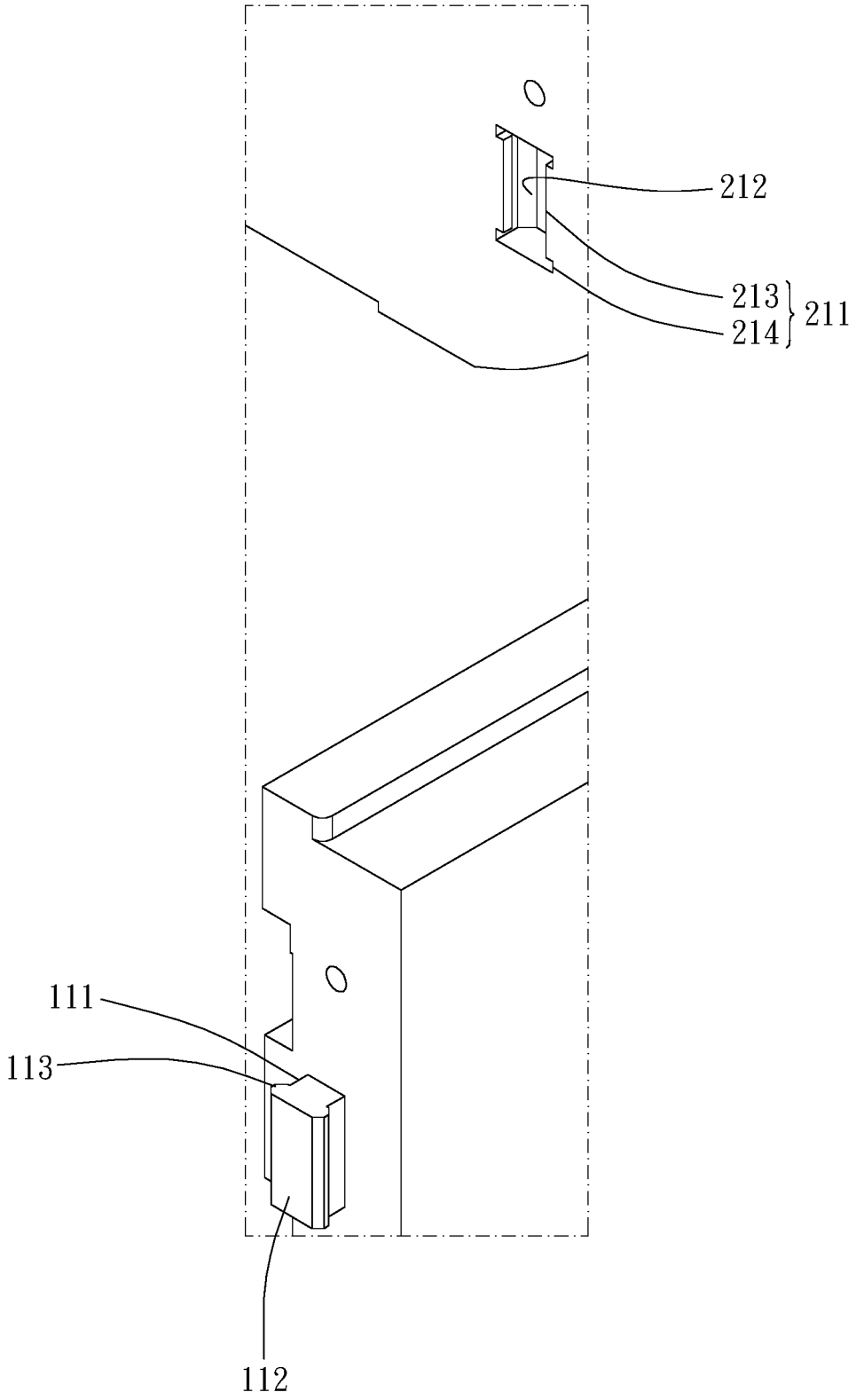
FIG. 4 is a partial breakdown drawing of a preferable embodiment of the present invention.
Figure 5:
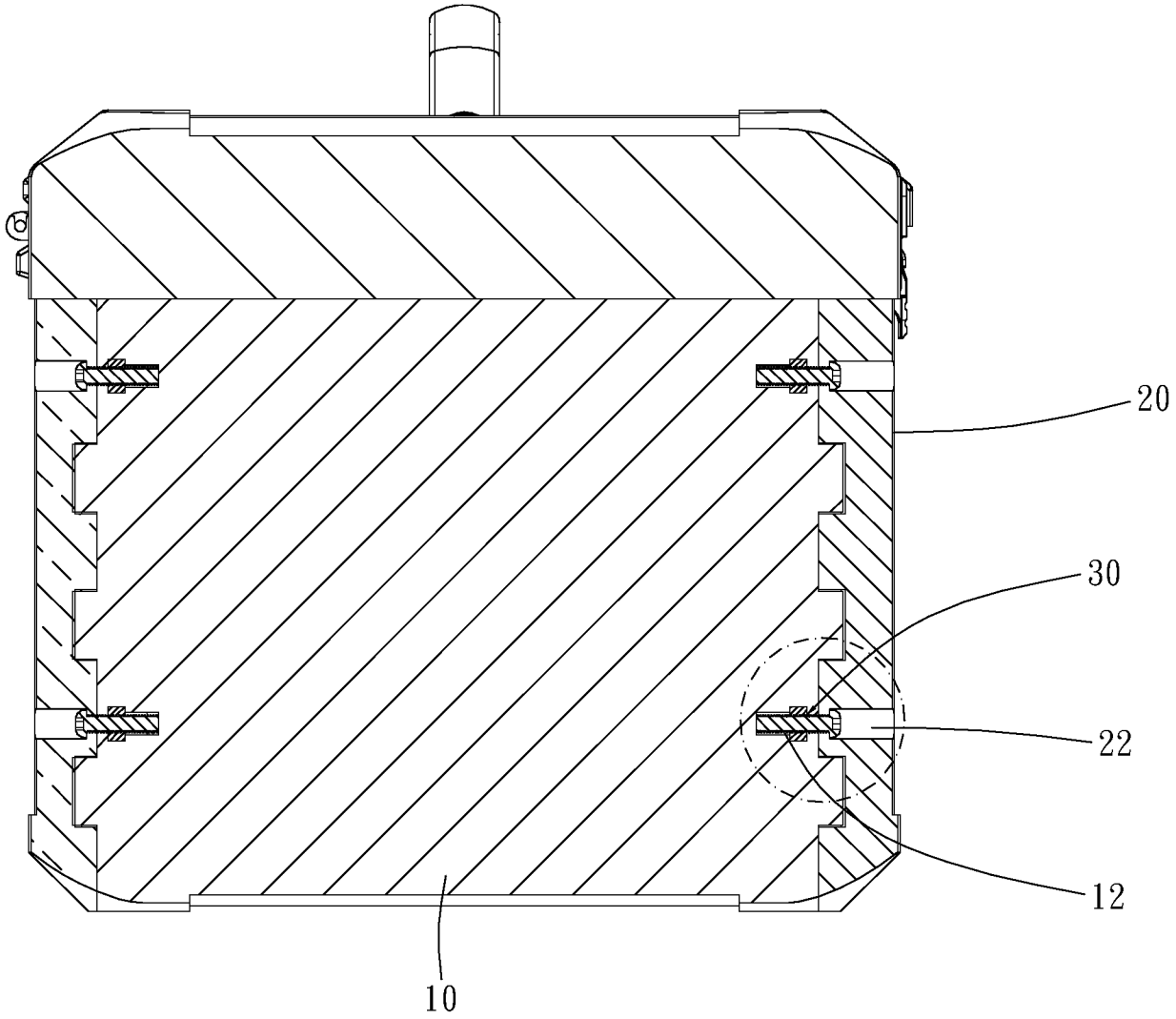
FIG. 5 is a cross-sectional view, taken along a line A-A of FIG. 1, of a preferable embodiment of the present invention.
Figure 6:
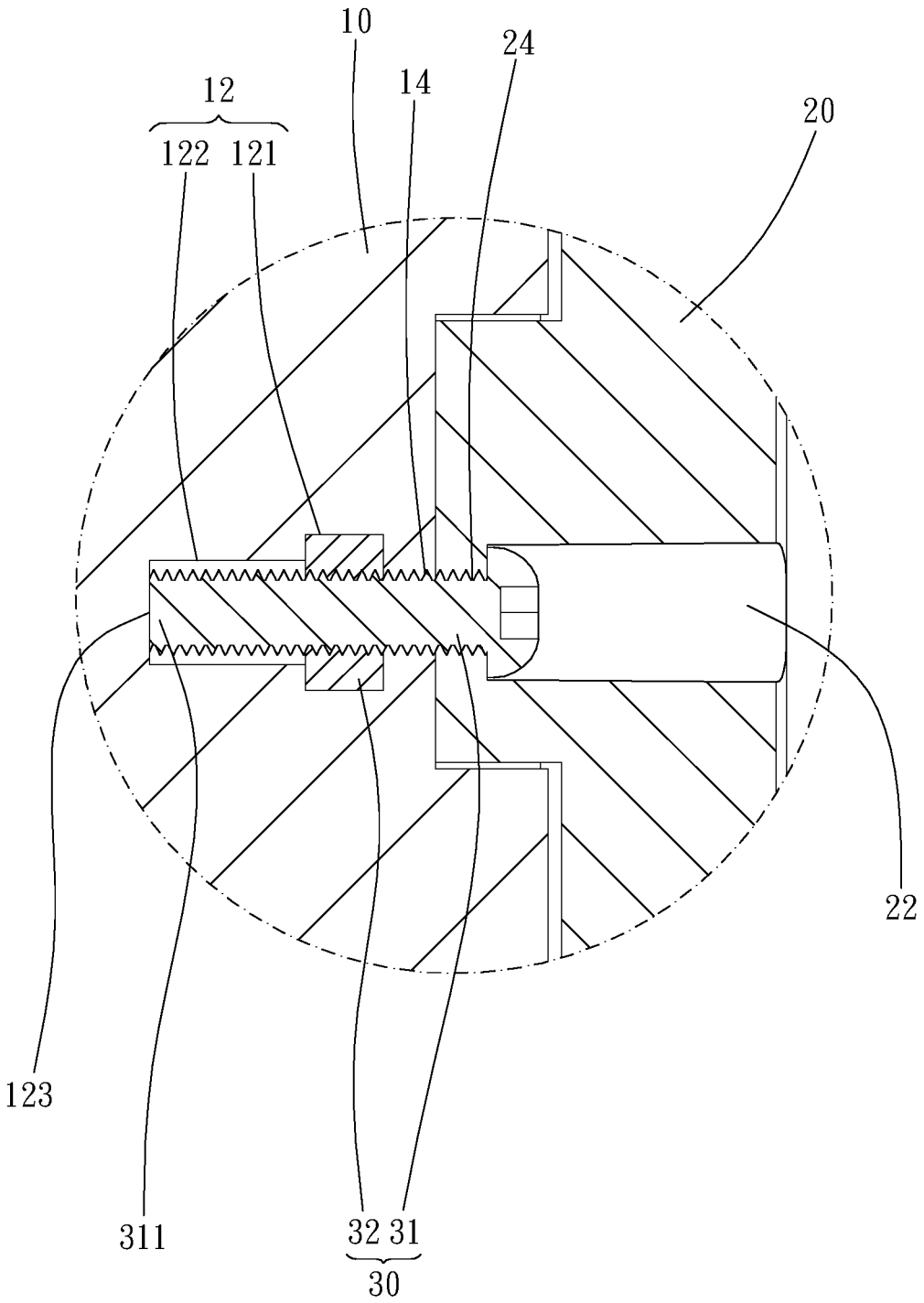
FIG. 6 is a partial enlargement of FIG. 5.
Figure 7:
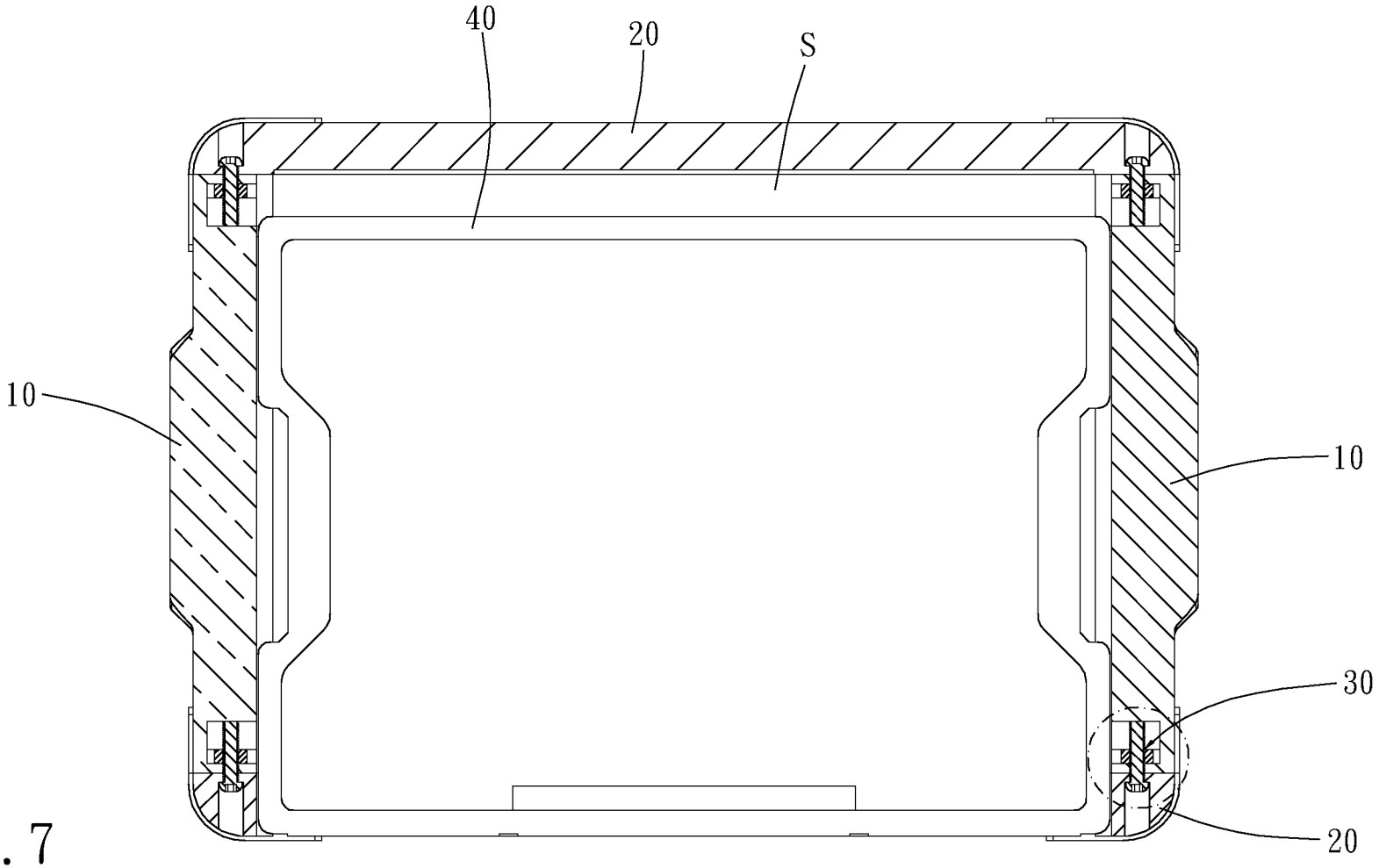
FIG. 7 is a cross-sectional view, taken along a line A-A of FIG. 1, of a preferable embodiment of the present invention.
Figure 8:
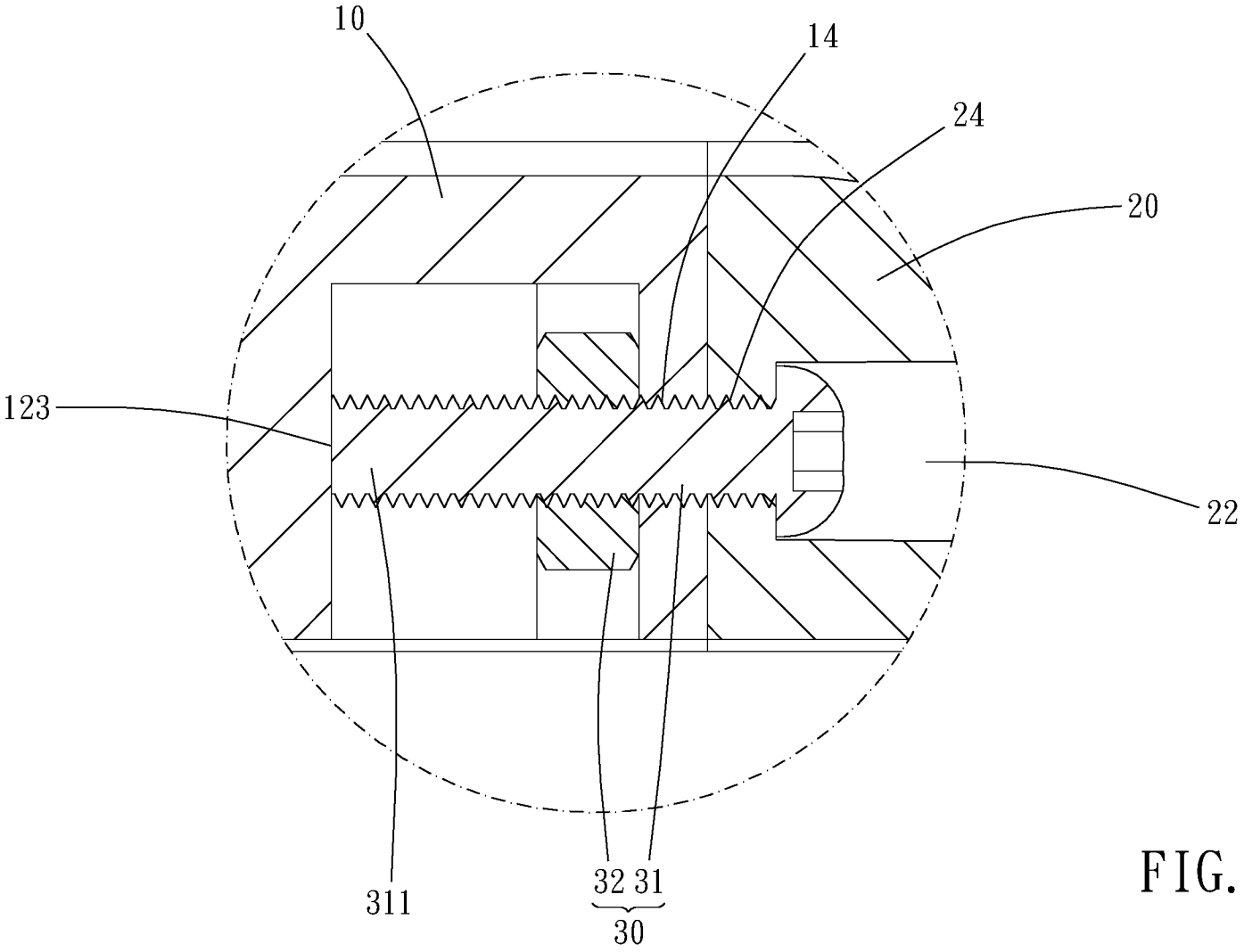
FIG. 8 is a partial enlargement of FIG. 7.
Figure 9:
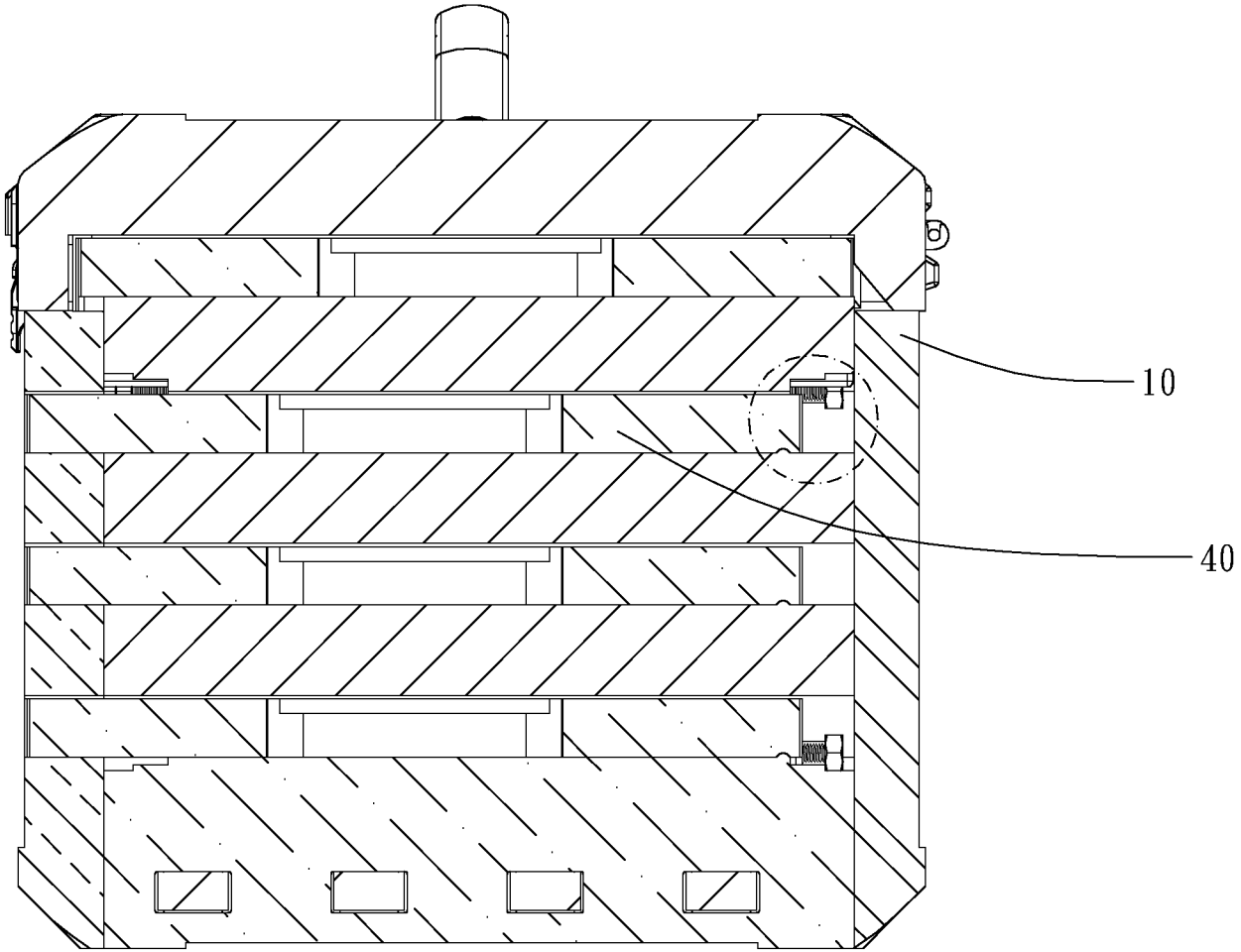
FIG. 9 is a cross-sectional view, taken along a line C-C of FIG. 1, of a preferable embodiment of the present invention.
Figure 10:
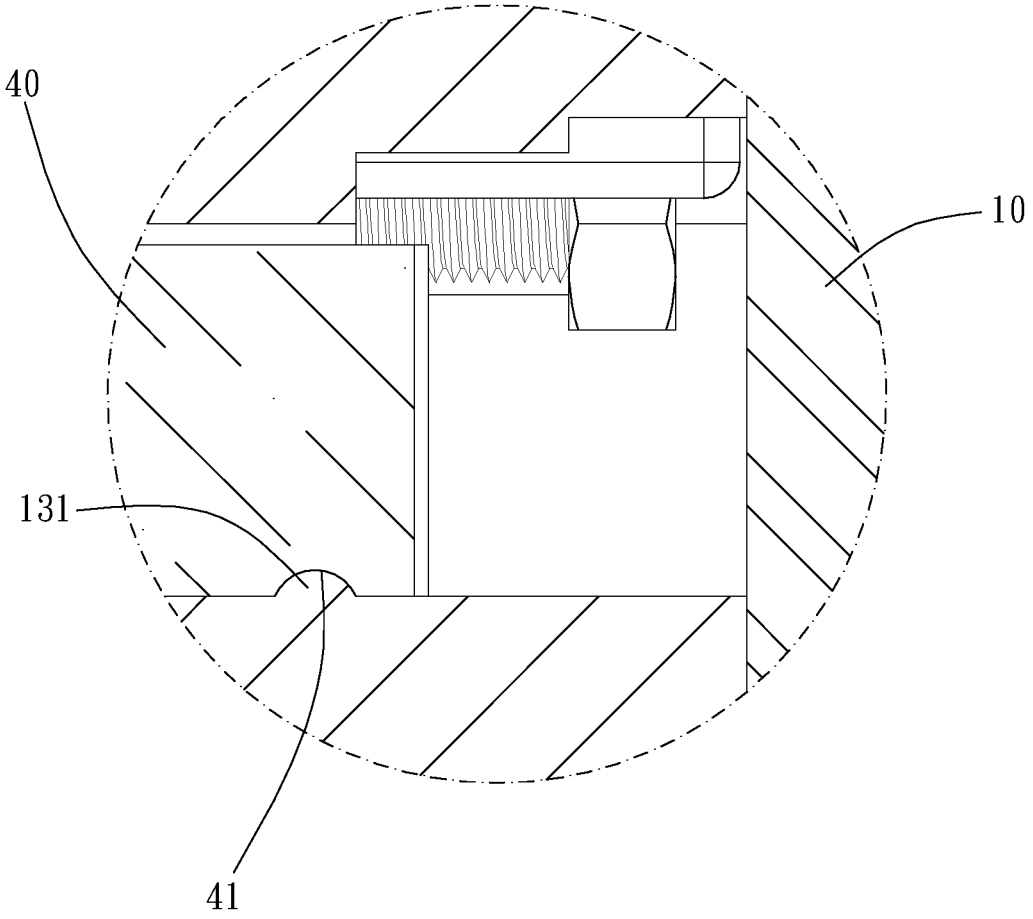
FIG. 10 is a partial enlargement of FIG. 9.

Please refer to FIGS. 1 to 10 for a preferable embodiment of the present invention. A combined toolbox 1 of the present invention includes a plurality of first side walls 10, a plurality of second side walls 20 and a plurality of fastening assemblies 30.

Each of the plurality of first side walls 10 includes a plurality of connection projections 11; each of the plurality of second side walls 20 each of the plurality of second side walls a plurality of connection recesses 21, adjacent said first and second side walls 10, 20 are connected by engagement of the plurality of connection projections 11 within the plurality of connection recesses 21, and the plurality of second side walls 20 and the plurality of first side walls 10 define a receiving space S; each of the plurality of fastening assemblies 30 includes a bolt 31 and a nut 32; wherein one of the adjacent said first and second side walls 10, 20 further includes a plurality of through holes 22, the other of the adjacent said first and second side walls 10, 20 further includes a plurality of receiving holes 12 which respectively correspond to the plurality of through holes 22; wherein each of the plurality of receiving holes 12 receives one said nut 32, each said bolt 31 is disposed through one of the plurality of through holes 22 and within one of the plurality of receiving holes 12 and is screwed with one said nut 32, and the bolt 31 and the nut 32 of each of the plurality of fastening assemblies 30 fixedly secure the adjacent said first and second side walls 10, 20. Whereby, the combined toolbox 1 is easy and quick to assemble, good in combination, good in resistance against external force and impact, and has strong connection strength which prevents detachment or breakdown.

Figure 11:
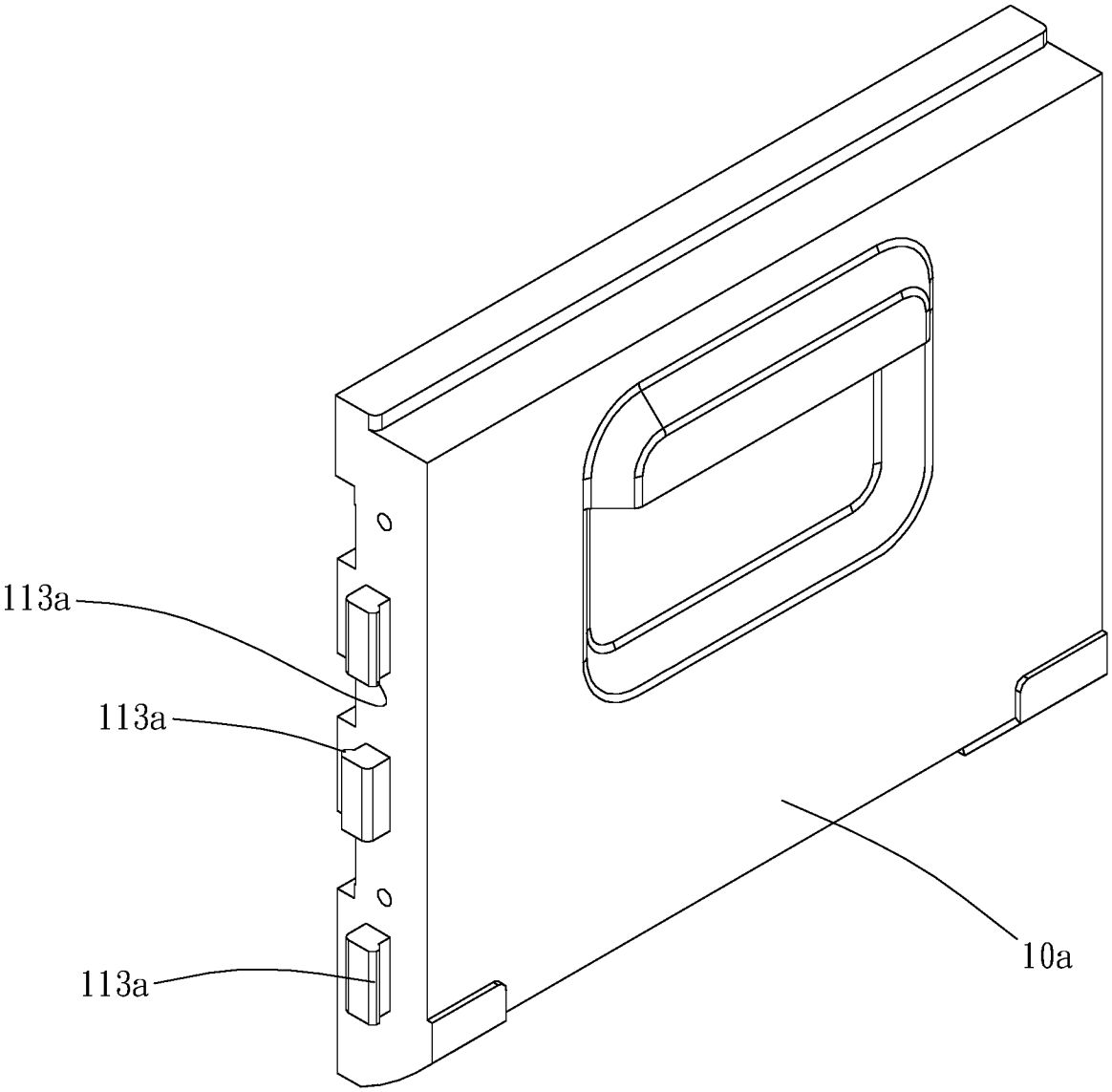
FIG. 11 is a stereogram of a first side wall according to a preferable embodiment of the present invention.

Each said connection projection 11 includes a necked portion 111 and an enlarged portion 112 connected with the necked portion 111, each said connection recess 21 includes a necked opening 211 and an inner room 212 in communication with the necked opening 211, each said enlarged portion 112 is disposed through one said necked opening 211 and blockably engaged within one said inner room 212, and each said necked opening 211 restricts one said necked portion 111. Each of two opposite sides of each said enlarged portion 112 includes a lateral flange 113. Specifically, each said necked opening 211 includes a narrowed section 213 and two widened sections 214 respectively connected to opposite sides of the narrowed section 213, and each said narrowed section 213 restricts one said necked portion 111. The narrowed section 213 and the lateral flange 113 provide easy and strong combination with the necked portion 111. In other embodiments, the plurality of said connection projections 11*a* of each said first side wall 10*a* are separately arranged along an arrangement direction and each include a lateral flange 113*a*, and on the arrangement direction, the lateral flanges 113*a* of adjacent two said connection projections 11*a* of each said first side wall 10*a* extend laterally in opposite directions (as shown in FIG. 11), and thus the lateral flange 113*a* is easy to be engaged with the narrowed section 213 and provides sufficient combination strength.

Preferably, the combined toolbox 1 further includes at least one storage tray 40, and the plurality of first side walls 10 and the plurality of second side walls 20 form a circumferential wall W. Each of two opposite sides of the circumferential wall W (here are two said first side walls 10) includes at least one slot 13, and each of two opposite sides of each said storage tray 40 is inserted within one said slot 13, which is easy for insertion and withdrawal of the at least one storage tray 40. An inner face of each said slot 13 includes a bump 131, and each of the two opposite sides of each said storage tray 40 includes a concave 41 within which one said bump 131 is positionably engageable.

In this embodiment, the combined toolbox 1 includes two said first side walls 10 and two said second side walls 20 and further includes a bottom side wall 50. The bottom side wall 50 includes a plurality of connection projections 51, the two said first side walls 10 are connected with part of the plurality of connection projections 51 on opposite sides of the bottom side wall 50, and the two said second side walls 20 are connected with another part of the plurality of connection projections 51 on other opposite sides of the bottom side wall 50; one of the two said first side walls 10 and the two said second side walls 20 (here is one said second side wall 20) further includes a frame body 23, the frame body 23 includes a plurality of grooves 231, each said groove 231 is correspondingly in communication with one said slot 13, each of two opposite sides of each said storage tray 40 is inserted within one said groove 231, which is easy for insertion, withdrawal and/or replacement of the at least one storage tray 40; the combined toolbox 1 further includes a lid 60, the lid 60 is movably connected with one of the two said first side walls 10 and the two said second side walls 20 (in this embodiment, the lid 60 is rotatably connected to one said second side wall 20), and the lid openably covers at a side of the receiving space S, which facilitates taking and storing tools; each said second side wall 20 includes a plurality of said through holes 22, each said second side wall 20 includes a plurality of said receiving holes 12, each said bolt 31 is disposed through a holed portion 14 of one said first side wall 10 and a holed portion 24 of one said second side wall 20 and is screwed with the holed portions 14, 24, which effectively avoids disengagement of the bolt 31 and enhances stable combination of the combined toolbox 1. In an alternative embodiment, the bottom side wall 50 may be integrally formed with at least one said first side wall 10 or integrally formed with at least one said second side wall 20 (formed in an L-shaped member, for example).

In this embodiment, each said receiving hole 12 includes a receiving section 121 receiving one said nut 32 and an extension section 122 in communication with and narrower than the receiving section 121. Each said bolt 31 is disposed through one said nut 32 and extends within one said extension section 122. Preferably, each said nut 32 is abutted laterally against an inner face of one said receiving hole 12 so that each said nut 32 is restricted in one said extension section 122; a distal end 311 of each said bolt 31 is abutted axially against an inner face 123 of one said receiving hole 12, which prevents disengagement of the bolt 31.

Figure 12:
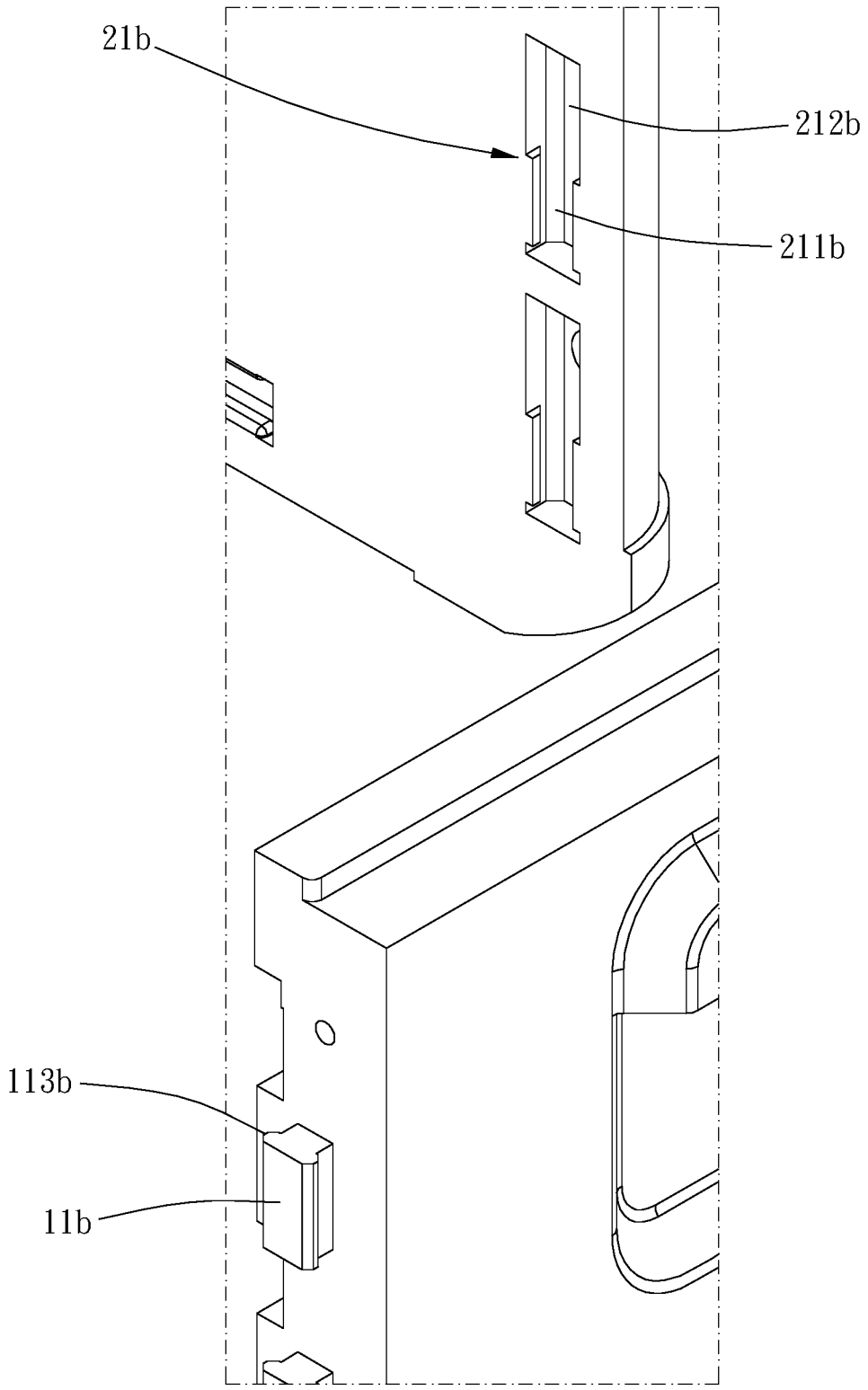
FIG. 12 is a partial breakdown drawing of a preferable embodiment of the present invention.

In another embodiment shown in FIG. 12, the connection recess 21*b* may further includes an insertion opening 212*b* whose extent is at least larger than an extent of the lateral flange 113*b* of the connection projection 11*b* so that the connection projection 11*b* can be inserted, via the insertion opening 212*b*, into the connection recess 21*b* and slides so that the lateral flange 113*b* of the connection projection 11*b* can be reliably blocked at the necked opening 211*b* of the connection recess 21*b*, which is easy and quick in assembling/disassembling.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A combined toolbox, including:

a plurality of first side walls, each of the plurality of first side walls including a plurality of connection projections;

a plurality of second side walls, each of the plurality of second side walls including a plurality of connection recesses, adjacent said first and second side walls being connected by engagement of the plurality of connection projections within the plurality of connection recesses, the plurality of first side walls and the plurality of second side walls defining a receiving space;

a plurality of fastening assemblies, each of the plurality of fastening assemblies including a bolt and a nut;

wherein one of the adjacent said first and second side walls further includes a plurality of through holes, and the other of the adjacent said first and second side walls further includes a plurality of receiving holes which respectively correspond to the plurality of through holes;

wherein each of the plurality of receiving holes receives one said nut, each said bolt is disposed through one of the plurality of through holes and within one of the plurality of receiving holes and is screwed with one said nut, and the bolt and the nut of each of the plurality of fastening assemblies fixedly secure the adjacent said first and second side walls;

wherein two opposing sides of each said nut are respectively abutted axially against an inner face of one said receiving hole, and another two opposing sides of each said nut are respectively abutted radially against the inner face of one said receiving hole;

wherein a distal end of each said bolt which is flat is abutted axially against the inner face of one said receiving hole;

wherein each said connection projection includes a necked portion and an enlarged portion connected with the necked portion, each said connection recess includes a necked opening and an inner room in communication with the necked opening, each said necked opening includes a narrowed section and two widened sections respectively connected to opposite sides of the narrowed section, each said enlarged portion is disposed through one said necked opening and blockably engaged within one said inner room, each said necked opening restricts one said necked portion, each said narrowed section restricts one said necked portion, and each of two opposite sides of each said enlarged portion includes a lateral flange;

wherein each said connection recess further includes an insertion opening whose extent is at least larger than an extent of the lateral flange of the connection projection so that the connection projection can be inserted, via the insertion opening, into the connection recess and slides so that the lateral flange of the connection projection can be reliably blocked at the necked opening of the connection recess.

2. The combined toolbox of claim 1, wherein the plurality of said connection projections of each said first side wall are separately arranged along an arrangement direction and each include a lateral flange, and on the arrangement direction, the lateral flanges of adjacent two said connection projections of each said first side wall extend laterally in opposite directions.

3. The combined toolbox of claim 1, further includes at least one storage tray, wherein the plurality of first side walls and the plurality of second side walls form a circumferential wall, each of two opposite sides of the circumferential wall includes at least one slot, and each of two opposite sides of each said storage tray is inserted within one said slot.

4. The combined toolbox of claim 3, wherein an inner face of each said slot includes a bump, and each of the two opposite sides of each said storage tray includes a concave within which one said bump is engageable.

5. The combined toolbox of claim 4, wherein the combined toolbox includes two said first side walls and two said second side walls and further includes a bottom side wall, the bottom side wall includes a plurality of connection projections, the two said first side walls are connected with part of the plurality of connection projections on opposite sides of the bottom side wall, the two said second side walls are connected with another part of the plurality of connection projections on other opposite sides of the bottom side wall; one of the two said first side walls and the two said second side walls further includes a frame body, the frame body includes a plurality of grooves, each said groove is correspondingly in communication with one said slot, each of two opposite sides of each said storage tray is inserted within one said groove; the combined toolbox further includes a lid, the lid is movably connected with one of the two said first side walls and the two said second side walls, the lid openably covers at a side of the receiving space; each said bolt is disposed through a holed portion of one said first side wall and a holed portion of one said second side wall and is screwed with the holed portions.

6. The combined toolbox of claim 1, wherein each said receiving hole includes a receiving section receiving one said nut and an extension section in communication with and narrower than the receiving section, and each said bolt is disposed through one said nut and extends within one said extension section.

* * * * *